US005669753A

United States Patent [19]

Schween

[11] Patent Number: 5,669,753

[45] Date of Patent: Sep. 23, 1997

[54] MODULAR AUTOMATED PARKING SYSTEM

[76] Inventor: Heiner Schween, 240 Windward Passage, #1103, Clearwater, Fla. 34630

[21] Appl. No.: 352,945

[22] Filed: Dec. 9, 1994

[51] Int. Cl.[6] ..... E04H 6/12

[52] U.S. Cl. ..... 414/786; 414/239; 414/262; 414/264

[58] Field of Search ..... 414/234, 233, 414/236, 237, 239–241, 262, 264, 279, 786

[56] References Cited

U.S. PATENT DOCUMENTS

| | | | |
|---|---|---|---|
| 2,598,750 | 6/1952 | Bargehr | 414/262 X |
| 2,864,515 | 12/1958 | Marshall | 414/234 |
| 3,125,235 | 3/1964 | Frangos | 414/239 |
| 3,217,905 | 11/1965 | Frangos | 414/239 |
| 3,924,300 | 12/1975 | Hilger et al. | 414/279 X |
| 4,170,310 | 10/1979 | Bajulaz | 414/241 |
| 5,069,592 | 12/1991 | Galperin | 414/240 |
| 5,238,348 | 8/1993 | Reimer | 414/279 X |
| 5,281,069 | 1/1994 | Tsujimoto | 414/239 X |
| 5,383,757 | 1/1995 | Takaoka et al. | 414/264 X |
| 5,425,612 | 6/1995 | Ebstein | 414/264 X |
| 5,456,562 | 10/1995 | Schlecker et al. | 414/264 X |

FOREIGN PATENT DOCUMENTS

| | | | |
|---|---|---|---|
| 685866 | 12/1939 | Germany | 414/240 |
| 678310 | 8/1991 | Switzerland | 414/279 |
| 2032867 | 5/1980 | United Kingdom | 414/279 |
| 2052456 | 1/1981 | United Kingdom | 414/279 |

*Primary Examiner*—David A. Bucci

[57] ABSTRACT

An automated parking garage simultaneously parks and retrieves multiple vehicles. Each vehicle entering the facility is videotaped to make a record of its physical condition prior to entry into the garage to protect the garage owner from baseless damage claims. Vehicles are simultaneously measured and entry into the garage is denied to oversized vehicles. Upon being granted entry, a customer parks the customer's vehicle on a pallet near the garage entrance and leaves the facility. In single floor designs, the pallet is carried by a self-propelled carrier to a parking space by a series of longitudinal and transverse movements on rails. A multiple story embodiment employs a lifting device that includes a pallet support member that shuttles back and forth between two contiguous floors. Each pallet is carried by a carrier to a lifting device and each lifting device has mechanical arms that support the carrier until the pallet support member deploys and independently supports the pallet to enable withdrawal of the carrier from the lifting device. Another carrier, stationed on an upper floor, retrieves the vehicle-supporting pallet from the lifting device and delivers it to its assigned parking space. Insertion and retrieval of multiple vehicles occurs simultaneously so that the formation of queues of vehicles entering the facility is minimized.

4 Claims, 14 Drawing Sheets

MODULAR AUTOMATED PARKING SYSTEM

BACKGROUND OF THE INVENTION

1. Technical Field

This invention relates, generally, to automated parking garages. More particularly, it relates to a comprehensive parking system that handles multiple tasks simultaneously.

2. Description of the Prior Art

Simple automated parking garage systems typically include an elevator within which a customer parks his or her vehicle; the customer pushes a button when the vehicle is fully within the elevator, and the elevator then carries the car and customer upwardly or downwardly to a parking level. The customer then drives the car to a parking space and exits the vehicle. The procedure is reversed when the customer is ready to leave the parking garage. Simple systems of this type have the advantage of eliminating space-consuming ramps between the floors of the facility.

More advanced systems include computer-controlled specialized equipment for carrying vehicles to assigned parking spaces in much the same way that computerized warehouses store and retrieve miscellaneous goods. In such warehouse systems, a computer assigns a location for each item as it is received from its manufacturer, and robotic equipment carries each item to its assigned location. The same equipment is dispatched to the location when the item requires retrieval.

One common feature of most of the known systems is that they rely upon conventional elevators to carry items from one floor to another. Thus, bottlenecks form due to the well-known inability of elevators to perform multiple tasks simultaneously. The conventional solution of this problem is to include multiple elevators for high volume use applications, but of course that adds to the cost of the system and is not particularly energy efficient.

Another system, known as the carousel system, is restricted to a single level parking garage. Perhaps more importantly, carousel systems have a common inlet and outlet port; thus, no vehicle can be retrieved from the system at the same time another vehicle is being introduced into the system, and vice versa. Moreover, since all of the vehicles are parked on a single turntable, each insertion into or retrieval of a vehicle from the system requires a substantial amount of energy consumption.

All of the known systems perform their intended functions and as such have utility, but none of them represents the pinnacle of parking garage technology.

For example, many of the known systems can handle only one vehicle and one procedure at a time. Thus, such systems cannot park an incoming vehicle at the same time they are retrieving an outgoing vehicle, and vice versa. As a result, an unacceptably long queue often forms at the entrance of such a garage during periods of high volume business.

Parking garage customers also attempt, from time to time, to park oversized vehicles. A vehicle that is too long for its parking space might block other vehicles from entering or exiting the facility. A vehicle that is too high or wide might be damaged by scraping the ceiling or walls of the parking garage, leading to the filing of a claim for compensation by the vehicle owner.

Even worse, some unscrupulous vehicle owners will park an already-damaged vehicle in a parking garage, and thereafter contend that their vehicle was undamaged at the time of entry into the garage, asserting that garage personnel are responsible for the damage allegedly inflicted on the vehicle while in the custody of the garage owner.

One of the needs of the parking garage industry, then, is for an automated parking system that is capable of directing incoming vehicles to parking spaces at the same time outgoing vehicles are retrieved. An ideal system would handle multiple simultaneous introductions and retrievals of vehicles into and from the system, respectively. Moreover, each vehicle would be handled independently of the others so that energy consumption would be minimized.

There is also a need for a system that permits the customer to leave the vehicle soon after entering the parking garage, i.e., a system is needed that does not require the customer to travel with the vehicle in an elevator and to drive the vehicle to a parking space after the elevator arrives at a predetermined floor of the parking garage.

Moreover, a need exists for a system that prevents oversized vehicles from entering the parking garage.

A system that protects parking garage owners from unfounded damage claims is also needed.

Perhaps most of all, there is a clear need for a means that eliminates reliance upon conventional elevators and the bottlenecks associated therewith.

However, in view of the art at the time the present invention was made, it was not obvious to those of ordinary skill in the parking garage industry how the limitations of the art could be overcome. The conventional wisdom is that the limitations of existing systems will best be overcome by providing more and faster elevators, better computer programs, more versatile robots, and the like.

SUMMARY OF THE INVENTION

The longstanding but heretofore unfulfilled need for a parking garage that fulfills the needs of the industry is now provided in the form of a comprehensive system that prevents entry of oversized vehicles into the system, that provides a record of each vehicle's physical condition prior to entry into the garage, that enables customers to leave their vehicles immediately after entering the garage, that simultaneously parks and retrieves a plurality of vehicles, and which performs all of these functions with a minimum amount of energy consumption and in the absence of conventional elevators.

The novel structure also incorporates a number of other unique features such as a service bay where vehicles may be washed and waxed, provided with an oil change, or otherwise serviced, as well as loading and unloading terminals where a customer may retrieve a car from its parking space to load items thereinto without removing the vehicle from the facility.

A customer's vehicle is first driven by the customer into an inspection area where the height and length of the vehicle are measured. If the dimensions of the vehicle fall outside the predetermined acceptable dimensions for that particular parking facility, the customer is advised that the garage cannot accommodate the vehicle and a barrier that prevents access of vehicles into the garage is not lifted or otherwise removed. Instead, an exit barrier is removed and the driver is directed back into the normal traffic flow past the facility.

If the vehicle's dimensions fall within the acceptable range, a plurality of strategically placed video cameras is activated and a videotape record is made of the physical condition of the vehicle. This enables the garage owner to defeat baseless damage claims that may be filed by unscrupulous vehicle owners. Simultaneously, a central computer determines the floor, row, and parking space number for that particular vehicle, and a ticket indicating the assigned space and the time of entry into the facility is automatically dispensed to the driver.

Upon completion of the videotaping and the dispensing of the ticket, a barrier is removed and the driver is directed to a nearby arrival station within which a vehicle-supporting pallet has been prepositioned. The driver parks the vehicle on said pallet and the driver and all passengers exit the vehicle.

Advantageously, the pallet is supported by a plurality of upstanding telescoping posts and is flanked by passenger-supporting platforms upon which the occupants of the vehicle walk when exiting or entering the vehicle. The respective vertical positions of the platforms are vertically adjustable, and said platforms are raised a small distance by suitable hydraulic or other means before the driver drives onto the pallet; the pallets may also be lowered to accomplish the same objective, or a combination of platform lifting and pallet lowering may be employed. The inner edge of each platform, i.e., the edge that abuts the pallet, is downwardly sloped to provide a slippery slope. Thus, a wide vehicle that is not parked in the middle of the pallet will be guided into the center of the pallet, i.e., the combination of the lowered pallet and raised platform create a recessed channel into which a vehicle will center itself even if not parked skillfully.

When the vehicle occupants exit the vehicle, a self-propelled pallet carrier having a low profile is dispatched by the central computer to that arrival station; the carrier travels on a railway or other suitable surface to the pallet and inserts itself underneath the pallet. A plurality of pallet-lifting pins that form a part of the carrier construction are then raised so that the pallet and vehicle supported thereatop are lifted upwardly. The carrier then transports the pallet and the vehicle thereatop to a highly novel lifting device.

In a preferred embodiment, the carrier is self-propelled, deriving its power from the rails or other support surface upon which it travels, but carriers not having that feature are within the scope of this invention. Each carrier, in the preferred embodiment, is also provided with an onboard computer.

If the vehicle is assigned by the central computer to be positioned in parking space number twenty six of the south row of the third floor of the parking garage, for example, it is lifted to said third floor by a highly novel lifting device; a conventional elevator is not employed.

The novel lifting device is a framed structure; the frame is formed by a plurality of upstanding steel channels that begin at the ground floor and extend to the uppermost floor of the facility. A pivotally mounted carrier support means is positioned along the extent of selected steel channel at one floor intervals. Similarly, a pallet support means is pivotally and movably mounted with respect to each channel at one floor intervals. Unlike the carrier support means, each pallet support means is adapted to travel a distance of one floor, i.e., each pallet support means reciprocates between a pair of contiguous floors under the control of the central computer means of the system.

In a preferred embodiment, there are four pairs of the upstanding steel channels so that each corner of a rectangular pallet is supported by a pallet support means; thus, there are a total of eight steel channels. Each pallet support means is formed by a pair of pallet support members that are movable in their respective channels independently of one another but conjointly with other pallet support means at the other corners of the frame so that one pallet support member of each pair thereof may lift or lower a pallet one floor while another member of the pair may descend or ascend, respectively, to fetch another pallet at the same time.

Vertically spaced apart pallet support members in adjacent channels momentarily horizontally align with one another when a pallet is being passed from one set of pallet support means to another, as will be more fully set forth hereinafter in the detailed decription that follows.

After retrieving a pallet with a vehicle thereatop, a carrier enters a lifting device that includes a pallet supporting means lowered into its ground floor disposition. Prior to said entry, a carrier support means that includes a pair of parallel rails or other suitable support means is swung into position to provide a support surface upon which the wheels of the carrier are rotatably supported when the carrier enters the lifting device. Upon entry of the pallet-carrying carrier into said lifting device, the pallet support means are swung into position to engage the underside of the pallet.

After said pallet has been so engaged, the above-mentioned pallet-lifting pins of the carrier are retracted; this disengages the carrier from the pallet and enables the carrier to exit the lifting device, leaving the pallet and vehicle supported thereby within the lifting device. The carrier then returns to an arrival station designated by the central computer to retrieve another vehicle-supporting pallet.

When the carrier exits the elevator, the carrier support means is pivotally or otherwise retracted to allow vertical travel of the pallet support means. As aforesaid, the pallet support means travels just one floor. In this example, the travel is from the ground level to the second floor of the parking garage. Upon arrival at the second floor, a second pallet support means pivotally deploys and engages the underside of the pallet and raises it to the third floor; this frees the first-mentioned pallet support means to descend to the ground floor to accept another vehicle-supporting carrier. Thus, another vehicle may be loaded into the system while the previous vehicle is still being lifted.

Like the first pallet support means, the second pallet support means also has a range of only one floor, i.e., it shuttles back and forth between the second and third floors. Upon arrival at the second floor of the first pallet support means, the second pallet support means engages the pallet and lifts it to the third floor as aforesaid and the first lifting device returns simultaneously to the ground floor to accept another vehicle. Upon arrival of the second pallet support means at the third floor, a carrier support means pivotally deploys and a carrier stationed on said third floor enters the lifting device and removes the pallet and vehicle therefrom, and the pallet support means returns to its second floor location to be ready for the next pallet-supported vehicle. This arrangement can be extended to cover any number of floors.

In the preferred embodiment, the carrier travels on rails, and the individual pallets that support the vehicles are similarly supported by rails when not supported by a carrier. However, systems that do not rely upon rails are well within the scope of this invention. For example, some garage owners might object to rails because an object might fall between the rails; the rails could then be mounted on solid floors to prevent such possibility. Moreover, rails might be eschewed completely. Recessed guide channels or protruding guide ridges could be formed in a solid floor, for example, to provide a mechanical means for steering carriers in lieu of rails. In lieu of mechanical guide means, various electrical, magnetic, optical, or other means could be employed to guide the carriers along a suport surface, and all of such means are within the scope of this invention. For example, a guide stripe could be painted on a floor and a photocell mounted on a carrier could follow the stripe. As another example, a metallic cable could be embedded in a concrete floor, and a carrier having ordinary rubber tires and having an electronic metal detecting device could follow the cable. Moreover, each carrier could be equipped with ball and socket-type wheels so that the carriers could turn without any turning circle, i.e., by pivoting if required at any point along a path of travel. The wheels could be mounted at the corners of the carrier, or two in line wheels could be provided.

Each floor of the parking garage has a central, transversely disposed track, and a plurality of carriers assigned to that floor shuttle back and forth on that track to deliver and retrieve vehicle-supporting pallets to and from individual parking spaces on the floor. There may also be one or more personal computers on each floor or on selected floors to supplant or complement the central computer.

Each floor also has a plurality of sets of longitudinal tracks arranged normal to the transverse axis of the central track in intersecting relation therewith. Each pair of longitudinal tracks supports a vehicle-supporting pallet. Thus, means are provided to enable the carrier to turn at right angles from the central transverse track to the individual longitudinal tracks when delivering or retrieving a pallet. Also, when one carrier needs to pass another, the carrier to be passed simply enters momentarily into an empty parking space.

Upon arriving at a point in alignment with parking space twenty six, south row, as in this example, the carrier retracts its central rail-engaging wheels, thereby lowering itself so that longitudinally disposed rail-engaging wheels on the underside thereof are lowered onto the longitudinal rails that define the selected parking space. The carrier enters into said space, retracts its pallet-supporting pins, thereby disengaging from the pallet, and exits the space leaving the pallet and vehicle supported thereby on said longitudinal rails. The carrier then returns to the lifting device to await the next vehicle-supporting pallet.

This process continues for as many times as needed, there being two sets of pallet support means required to deliver a vehicle to the third floor of a parking garage (the first set of four pallet support members traveling from ground level to the second floor and the second set traveling from the second floor to the third), three sets of pallet support means to deliver a vehicle to the fourth floor, and so on. This enables the ground floor pallet support means to quickly return to the ground floor after traveling just one floor to discharge its load so that said ground floor pallet support means may accept another vehicle into the system. The same observation applies to all of the other pallet support means as well, i.e., having to travel only one floor to accomplish their respective tasks, they can quickly return to their lowermost position to accept the next vehicle-supporting pallet. Thus, a plurality of vehicles may be entering and leaving the system simultaneously.

Note that the carrier-supporting means do not travel from floor to floor but merely deploy as needed to accept a carrier; after a carrier has entered the lifting device supported by said carrier support means and after a set of said pallet support means has engaged the underside of the pallet, the carrier support means retracts as mentioned earlier to allow vertical displacement of the pallet support means and said carrier support means thereafter deploy again under computer control to accept another carrier into the lifting device.

Numerous suitable means may be employed to raise and lower the pallet support means between floors. In a preferred embodiment, the means is provided in the form of a rack and pinion arrangement but hydraulic, pneumatic, and other means are within the scope of this invention.

Thus it is clear that the primary object of this invention is to provide an automated, versatile parking system that simultaneously handles introduction and retrieval of multiple vehicles in the substantial absence of human intervention.

A more specific object is to provide a lifting device and method for its use that eliminates the need for conventional elevators.

Another important object is to provide a parking system that controls the size of the vehicles that enter into it.

Still another important object is to provide a parking system that enables its owner to defeat baseless damage claims.

Still further objects include the provision of a unique carrier support means for supporting a carrier and a unique pallet support means for supporting a pallet, and a highly novel lifting device that provides a frame upon which said carrier support means and said pallet support means are mounted.

These and other important objects, features and advantages of the invention will become apparent as this description proceeds.

The invention accordingly comprises the features of construction, combination of elements and arangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
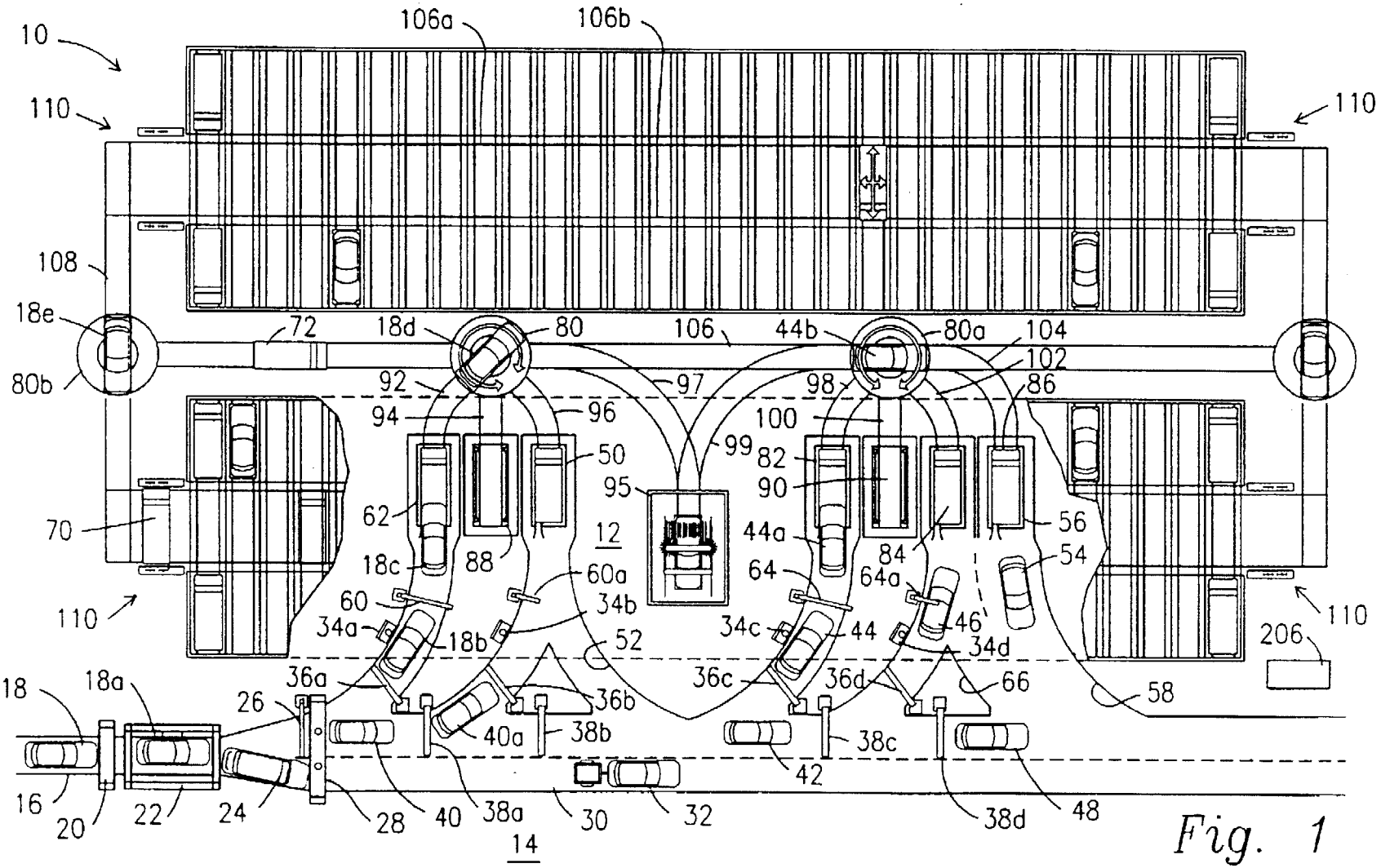
FIG. 1 is a plan view, partially broken away, of a an illustrative embodiment of the novel parking garage.

Referring now to FIG. 1, it will there be seen that an illustrative embodiment of the invention is denoted as a whole by the reference numeral 10.

Parking garage 10 includes a floor level 12 (near the center of the FIG.) that is substantially coplanar with the level of a street or highway 14 that carries traffic. To enter garage 10, a vehicle exits road 14 and pulls into garage entrance station 16 (lower left-hand corner); the reference numeral 18 indicates a vehicle that has pulled into said station 16. A barrier 20 under the control of a central computer, not shown, bars admittance until measuring station 22 is ready to accept another vehicle. When barrier 20 is removed, vehicle 18 enters measuring station 22; said vehicle is denoted 18*a* at said station 22. The height and length of the vehicle is measured by suitable means including photoelectric cells, lasers, or any other available technology having utility for such purpose.

Vehicle 24 has been denied access into garage 10 because its length, height, or both are excessive; note that barrier 26 has not been removed by the central computer so that said vehicle 24 is constrained to pass through gate 28 onto driveway 30. From said driveway 30, said vehicle 24 may reenter street or highway 14. Note further vehicle 32 which is shown already on said driveway 30; said vehicle is of normal size, but it was denied access into garage 10 because it was towing a trailer as shown.

Obviously, garage 10 could be built with oversized parking spaces to acommodate even the largest vehicles and a garage so constructed would not require measuring station 22, barrier 26, or exit driveway 14. However, such measurement would be advantageous in garages having pallets and parking spaces of differing sizes because long cars could be assigned to long pallets and long parking spaces and short cars could be assigned to short pallets and short parking spaces. Furthermore, two or more short-in-length vehicles could be parked in a single long parking space; thus, the capability to measure vehicle length is important in almost all applications. Moreover, if a garage owner desired to restrict the weight of vehicles entering the garage, a weighing means would be added to measuring station 22 and overweight vehicles could be excluded from the facility. Such alterations of the novel structure are clearly within the scope of this invention, as indicated in the claims that follow.

The vehicle is also videotaped at measuring station 22 to form a record of its physical condition prior to entry into the facility. Cameras are strategically placed about the periphery of said station 22 so that the physical condition of all four fenders, doors, bumpers, hood, trunk, windows and other external parts are clearly recorded for later reference if needed.

If a vehicle has acceptable dimensions, it is admitted into the facility by the removal of barrier 26. A series of barriers under the control of the central computer then directs it to a ticket-dispensing station. In the exemplary embodiment of FIG. 1, four ticket-dispensing stations are illustrated, although this invention is not restricted to any particular number of such stations. For purposes of explanation, the four ticket-dispensing stations are denoted 34*a*, 34*b*, 34*c*, and 34*d*. Each ticket-dispensing machine is preceded by an entrance gate and a bypass gate; in this example, the entrance gates are denoted 36*a*, 36*b*, 36*c*, and 36*d*, respectively, and the bypass gates are denoted 38*a*, 38*b*, 38*c*, and 38*d*, respectively. If an entrance gate is closed and its associated bypass gate is open, the vehicle is constrained to travel past the ticket-dispensing machine associated with the closed entrance gate. Vehicle 40 has been denied access to machine 34*a* because said machine is in the process of dispensing a ticket to vehicle 18*b*. However, bypass gate 38*a* is open and bypass gate 38*b* is closed so said vehicle is directed toward entrance gate 36*b*; vehicle 40 is denoted 40*a* at said entrance gate 36*b*. At machine 34*c*, vehicle 42 is depicted barred from ticket-dispensing station 34*c* because said station is performing its function with vehicle 44, and said vehicle 42 is further barred by bypass gate 38*c* because entrance gate 36*d* has not yet lifted since vehicle 46 has not yet fully departed from ticketing station 34*d*. Clearly, the blocking of vehicle 42 is momentary only. This momentary blocking of vehicle 42 is depicted to emphasize the fact that all gates are under the control of the central computer and that any combination of gate closings and openings is possible, said combinations being dictated by the rate of flow of traffic into the facility. Vehicle 48 is depicted leaving the facility; it was parked previously and has been retrieved in the manner disclosed in detail hereinafter and is returning to highway 14. More particularly, it was delivered to departure station 50 (near the center of the FIG.) and was driven by its driver over exit driveway 52 to its depicted position. Similarly, vehicle 54 is depicted exiting departure station 56 over exit driveway 58. Thus, it should be understood that facility 10 simultaneously handles arriving and departing vehicles. Significantly, the respective processes for the handling of arriving vehicles and the handling of departing vehicles are carried on independently of one another so that the number of arriving vehicles has no effect on the speed with which departing vehicles are handled, and vice versa.

Returning now to ticket-dispensing station 34*a*, it should be observed that barrier 60 bars forward travel of vehicle 18*b* until a ticket has been dispensed; barrier 60 is then removed and the vehicle is driven by its driver into arrival station 62; vehicle 18 is denoted 18*c* when entering said arrival station. Barrier 60*a*, associated with ticket-dispensing machine 34*b*, is only half as long as barrier 60 so as not to block exit driveway 52. Similarly, barrier 64a associated with ticket-dispensing machine 34d is half the length of barrier 64 so as not to block exit driveway 66.

When a ticket is dispensed, a particular floor, row, and space number is assigned to the vehicle by the central computer. The time the ticket was dispensed and the floor, row, and space number assigned to the vehicle are imprinted on the ticket, although all information other than the time could be provided in machine readable form. Where machine reading is employed, the driver or a system attendant causes a machine to scan the ticket when vehicle retrieval is desired and the system is activated to retrieve the vehicle in the manner hereinafter described.

The path of travel of vehicle 18 takes it from entrance station 16 to arrival station 62 as above-described. Station 62 includes a wheelless pallet 70 that is supported at its four corners by telescoping posts, two of which may be seen in FIG. 2 and which are denoted 71a and 71b. After parking the vehicle on said pallet 70, the vehicle occupants step upon arrival station platforms 62a and 62b (FIG. 2) that flank pallet 70. Platforms 62a and 62b are movably mounted so that they can be raised and lowered a few inches or so by hydraulic means 65a, 65b or other suitable means. Note that the inner edges 67a, 67b of each platform are downwardly sloped at an angle that will cause a vehicle's wheel to slide downwardly if a vehicle is sloppily parked upon the pallet. Slopes 67a, 67b may be exposed by raising platforms 62a, 62b, lowering telescopic support posts 71a, 71b, or by any combination of such raising and lowering, all of which are indicated by the double-headed directional arrow in FIG. 2.

Upon arrival of a vehicle such as vehicle 18 at any of the arrival stations of the novel system, such as arrival station 62, a preferably self-propelled wheeled carrier 72 is dispatched by the central computer to engage pallet 70 and to take it to its assigned parking space.

Figure 2:
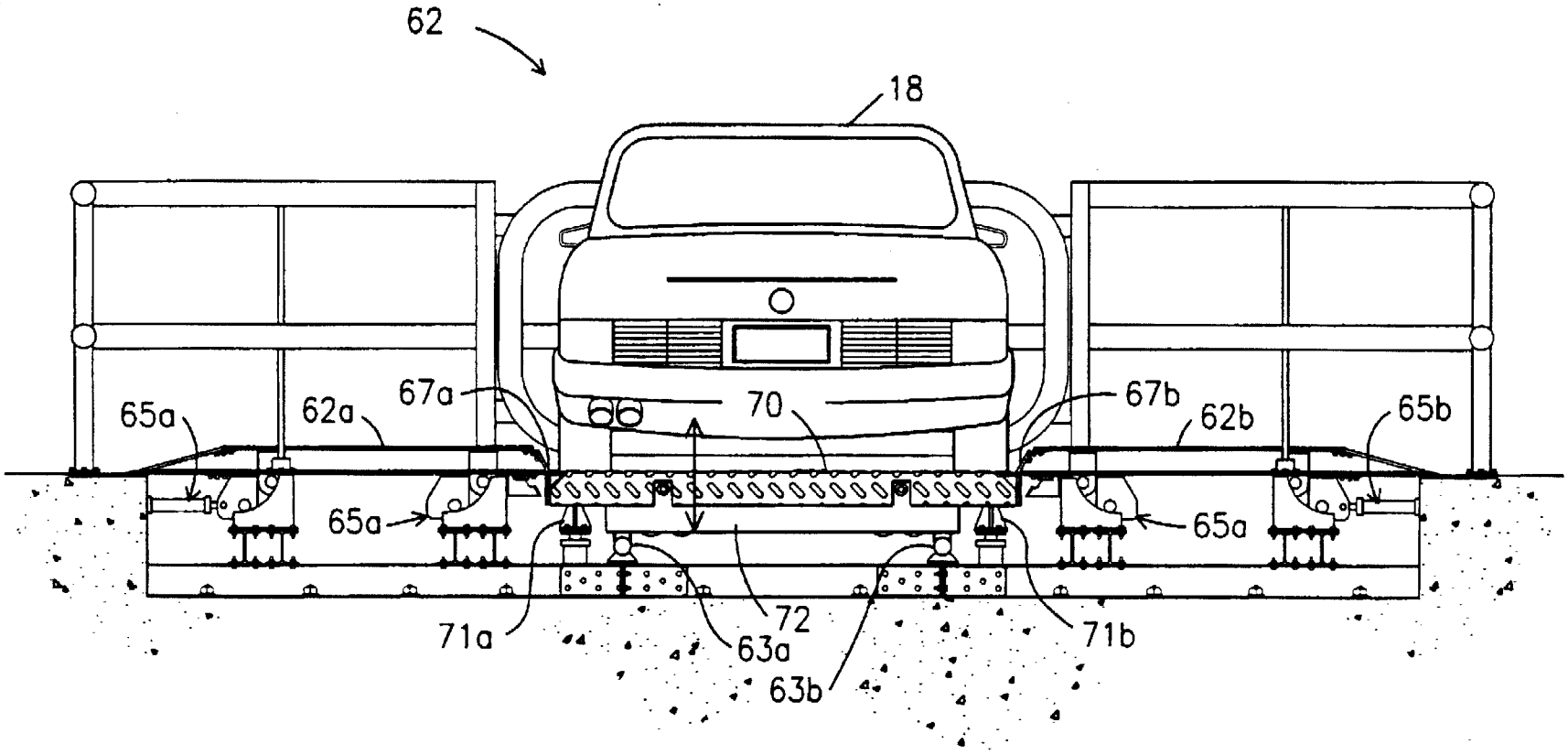
FIG. 2 is a front elevational view of a vehicle supported on a pallet at an arrival station.

As best understood in connection with FIG. 2, pallet 70 is not supported by wheels and merely rests atop said posts 71a, 71b.

Arrival station 62 further includes individual rails denoted 63a, 63b for supporting carrier 72. It is worthwhile to note that FIG. 2 can be construed as depicting not only the initial position of a vehicle that has been parked on a pallet at an arrival station, it may also be construed as depicting a vehicle parked in its assigned parking space, i.e., when a vehicle has been delivered to its assigned parking space, it is deposited by a carrier 72 atop support posts that are like support rails 71a, 71b in a manner to be more fully set forth hereinafter. However, the large passenger supporting platforms 62a, 62b are not provided at the assigned parking space because all passengers exit the vehicle at the arrival station, and the support posts at the parking space are not telescopic.

Carrier 72 has a low profile so that it may ride on rails 63a and 63b and still travel under pallet 70, as best understood in connection with FIG. 2. A sensor means is triggered by the entry of the carrier into the space below the pallet, and said sensor means sends a signal to the central computer indicating that the carrier is properly positioned. The central computer then sends a signal to the carrier, activating a plurality of lifting pins that extend upwardly from the carrier and which engage the underside of the pallet and raise it so that it is no longer supported by the support posts 71a, 71b. Instead, it is supported by said lifting pins and thus travels whereever carrier 72 travels.

To accomplish the initial lifting of a pallet and a vehicle thereatop, a carrier is dispatched by the central computer to turntable 80 (FIG. 1). There is one turntable 80 for every two or three arrival stations, as indicated in FIG. 1. For example, turntable 80 serves arrival station 62, loading/unloading terminal 88, arrival/departure station 50, and vehicle service area 95, and turntable 80a serves said area 95, arrival station 82, loading/unloading terminal 90, arrival/departure station 84 and departure station 56.

Note in FIG. 1 that loading/unloading terminals 88 and 90 have no means whereby a vehicle may be driven therefrom. Thus, terminals 88 and 90 may receive a vehicle from the parking garage, but the vehicle must be delivered to a departure station such as stations 50, 58, and 84 before a customer may exit the facility. The purpose of terminals 88 and 90 is to enable a customer to retrieve a vehicle for the purpose of retrieving something that may have been forgotten and left in the vehicle or for the purpose of depositing something into the vehicle. The facilty operator may or may not add an extra fee to the customer's parking fee for each retrieval of the vehicle.

Each turntable is a circular disc mounted for rotation in a horizontal plane in either direction about its center as indicated by the double headed directional arrows on both of said turntables. A pair of parallel rails on the same plane as rails 63a, 63b (FIG. 2) are mounted to a top surface of each turntable to support a carrier thereatop. Note that turntable 80 is connected to arrival station 62 by arcuate rails 92, to loading/unloading terminal 88 by straight rails 94, to arrival/departure station 50 by arcuate rails 96, and to car service station 95 by arcuate rails 97. Similarly, turntable 80a is interconnected to car service station 95 by arcuate rails 99, to arrival station 82 by arcuate rails 98, to loading/unloading terminal 90 by straight rails 100, to arrival/departure station 84 by arcuate rails 102, and to departure station 56 by rails 104.

It should be noted that the rails or other means for interconnecting the respective turntables and arrival stations, departure stations, arrival/departure stations, loading/unloading terminals, car service stations, and the like, may be of any length and configuration. Specifically, one or more departure stations could be positioned near the airside arrival gate of an airline company so that arriving passengers could retrieve their vehicles from a remote automated garage. This would enable a car rental company, for example, to maintain a modular automatic parking system at a remote location relative to the airside terminal without causing inconvenience to travelers.

Moreover, since all of the turntables are rotatable three hundred sixty degrees, retrieved vehicles may be delivered to a departure station facing in the direction of travel therefrom. This contrasts with conventional parking systems that deliver a vehicle facing away from the direction of the exit whereby the driver is required to back the vehicle out of the departure station.

To retrieve vehicle 18 from arrival station 62 for introduction into the parking facility, turntable 80 rotates until its rails align with arcuate rails 92 as depicted in FIG. 1. The carrier then exits said turntable, inserts itself under pallet 70, lifts the pallet, and returns to the turntable over said arcuate rails 92. The turntable then rotates until its rails align with elongate parallel rails 106. For purposes of this disclosure, rails 106 will be said to be transversly extending. Vehicle 44b is depicted in such alignment. The carrier then travels to end turntable 80b (at the left side of FIG. 1) which is also equipped with a pair of parallel rails. Turntable 80b is aligned to receive the carrier by the central computer. After the carrier has positioned itself atop turntable 80b, said turntable 80b rotates ninety degrees so that vehicle 18, denoted 18e when on turntable 80b, is aligned with rails that extend into lifting device 110.

The turntable operates in the same way to deliver vehicles to a loading/unloading terminal, such as terminal 88, to arrival/departure station 50 or to service area 95.

An automated or semi-automated car wash machine may be installed at service area 95, and suitable means are provided at each ticket-dispensing station whereby a customer may pay an extra fee to have a vehicle washed, waxed, or otherwise serviced. Alternatively, service area 95 could include a quick oil change facility, a fueling station, or other service feature selected by a facility owner.

Note that in this exemplary embodiment, there are four lifting devices, collectively denoted 110 as a whole, but any number thereof is of course within the scope of this invention. Each lifting device includes a plurality of pivotally mounted carrier support means and pallet support means, the latter of which shuttles back and forth between two levels only and each of which is under the independent control of the central computer. Thus, one of more lifting devices may be performing the task of lifting a vehicle to a higher level at the same time one or more lifting devices are lowering their respective vehicles. If a descending vehicle meets an ascending vehicle, the central computer commands a floor-stationed carrier to side track one of the vehicles onto a garage level to allow the other vehicle to pass, after which said side-tracked vehicle reenters the lifting device and resumes its ascent or descent.

Each lifting device is specifically structured to perform the functions of accepting a carrier and associated pallet thereinto and engaging the pallet so that the carrier may withdraw from the lifting device. Thereafter, the vehicle and pallet are lifted one level only as aforesaid, and the vehicle and pallet are then engaged by the next higher pallet support members and lifted another floor until the assigned floor is reached. Upon reaching the assigned floor, a carrier on said assigned floor enters the lifting device and removes the carrier and pallet for parking on that floor.

FIGS. 3A–E depict the operation of novel lifting device 110. A plurality of pivotally mounted carrier support members 112a, 112b performs the function of supporting a carrier so that a carrier carrying a pallet may enter into lifting device 110, and a plurality of pivotally mounted pallet support members 114a, 114b performs the functions of relieving the carrier of its pallet-supporting duty after full insertion of the pallet into the lifting device and further performs the funtion of lifting the pallet and vehicle supported thereby after the carrier has exited the lifting device.

Figure 3A:
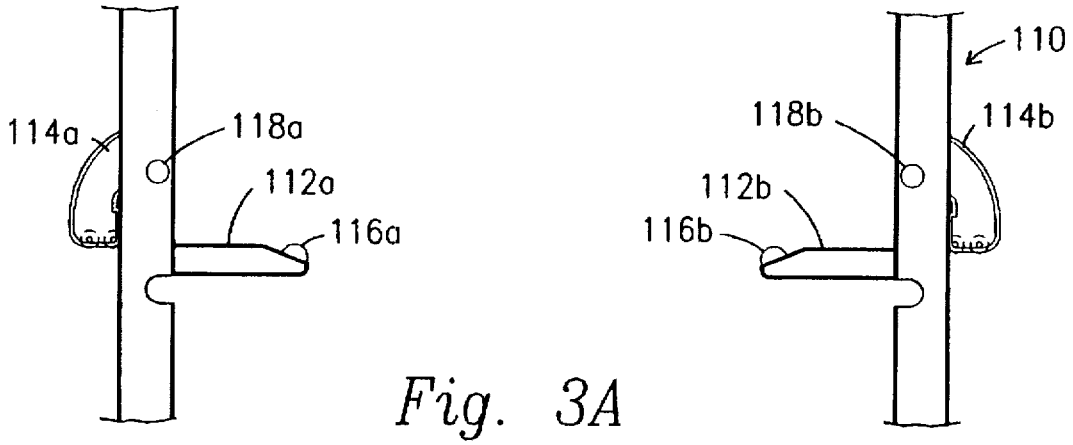
FIG. 3A is a side elevational view of a lifting device with the carrier support means deployed and ready to accept insertion of a carrier and with the pallet support means retracted.

To prepare an empty lifting device to receive a carrier and pallet, each carrier support member 112a, 112b is in its "deployed" configuration and each pallet support member 114a, 114b is in its "retracted" configuration as depicted in FIG. 3A. When said support members are so configured, lifting device 110 will accept insertion of a pallet-bearing carrier.

Figure 3B:
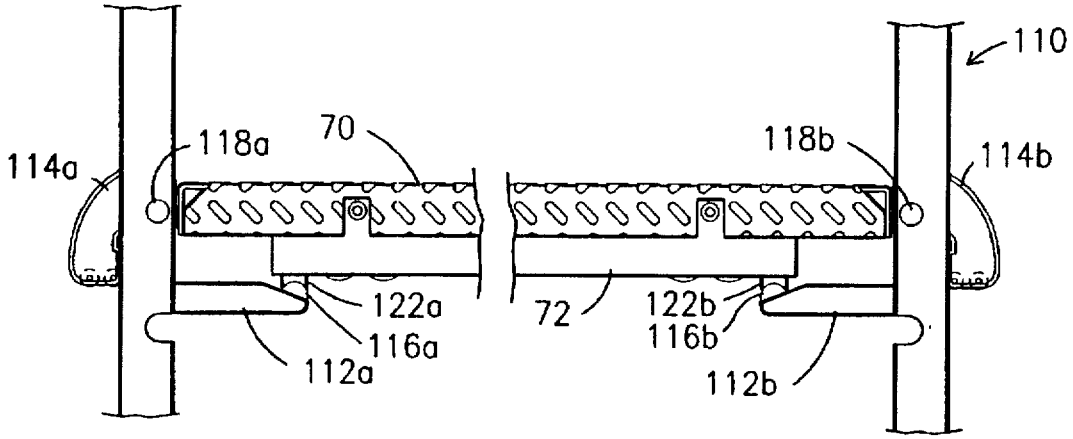
FIG. 3B is a side elevational view of the lifting device in the FIG. 3A configuration when it has accepted insertion of a carrier and a pallet suported by said carrier.

The next stage of operation is depicted in FIG. 3B; that FIG. illustrates the configuration of a lifting device 110 after a pallet-bearing carrier 72 has entered thereinto; the respective positions of arms 112a, 112b and 114a, 114b is unchanged from their respective positions depicted in FIG. 3A. Carrier 72, which has a set of longitudinally aligned railroad-type wheels 122a, 122b rotatably mounted to its underside, is supported by a pair of rails 116a, 116b at the outermost end of each arm 112a, 112b, said rails 116a, 116b engaging said carrier wheels as depicted. Accordingly, the carrier, under its own power, enters lifting device 110 by traveling from the turntable rails to rails 116a, 116b, said rails of course being coplanar.

Figure 3C:
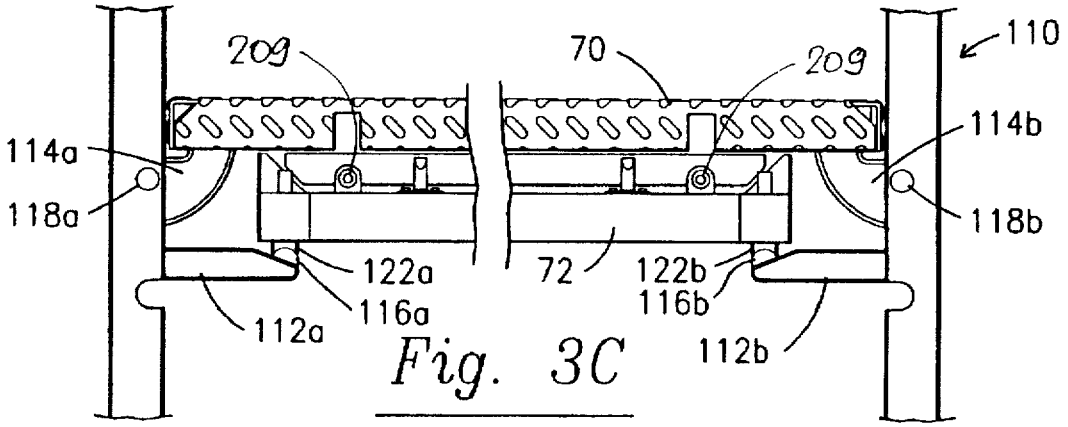
FIG. 3C is a side elevational view of the lifting device in a configuration when the pallet support means has been fully rotated to engage the underside of the pallet so that the carrier is no longer needed to support said pallet.

The next step in the procedure is illustrated in FIG. 3C. There it will be seen that arms 114a, 114b are now in their deployed configuration. Compare the position of pallet 70 in FIG. 3C with its position in FIG. 3B; note that it has been lifted in FIG. 3C from its FIG. 3B position. Said lifting has been performed by rotating arms 114a, 114b about their respective pivot points 118a, 118b. Such rotation lifts pallet 70 from carrier 72, thereby enabling withdrawal of said carrier.

Figure 3D:
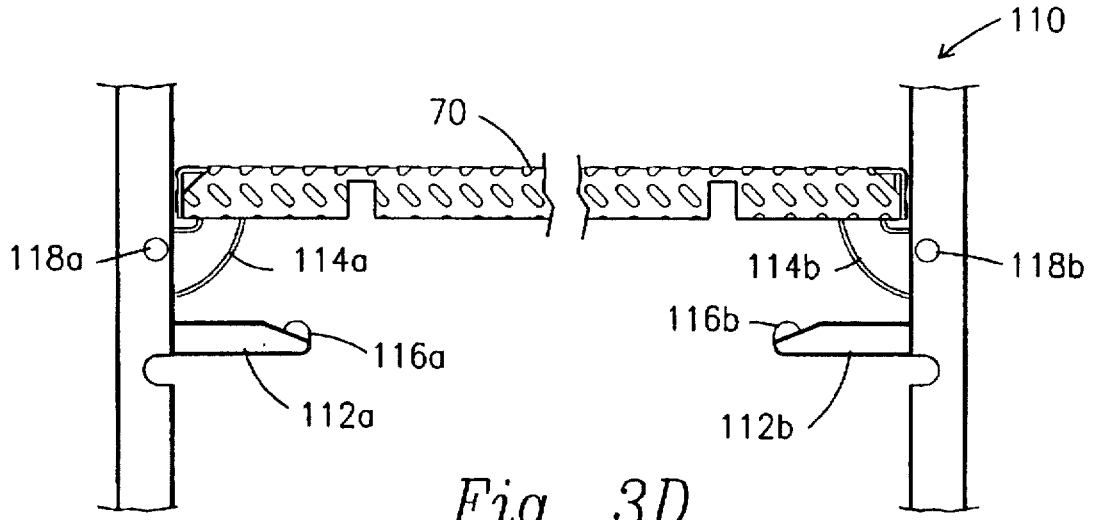
FIG. 3D is a side elevational view of the lifting device of FIG. 3C when the carrier has exited therefrom.

The configuration of the lifting device after carrier 72 has withdrawn therefrom is depicted in FIG. 3D. Note that the respective positions of arms 112a, 112b and 114a, 114b remains the same as in FIG. 3C.

Figure 3E:
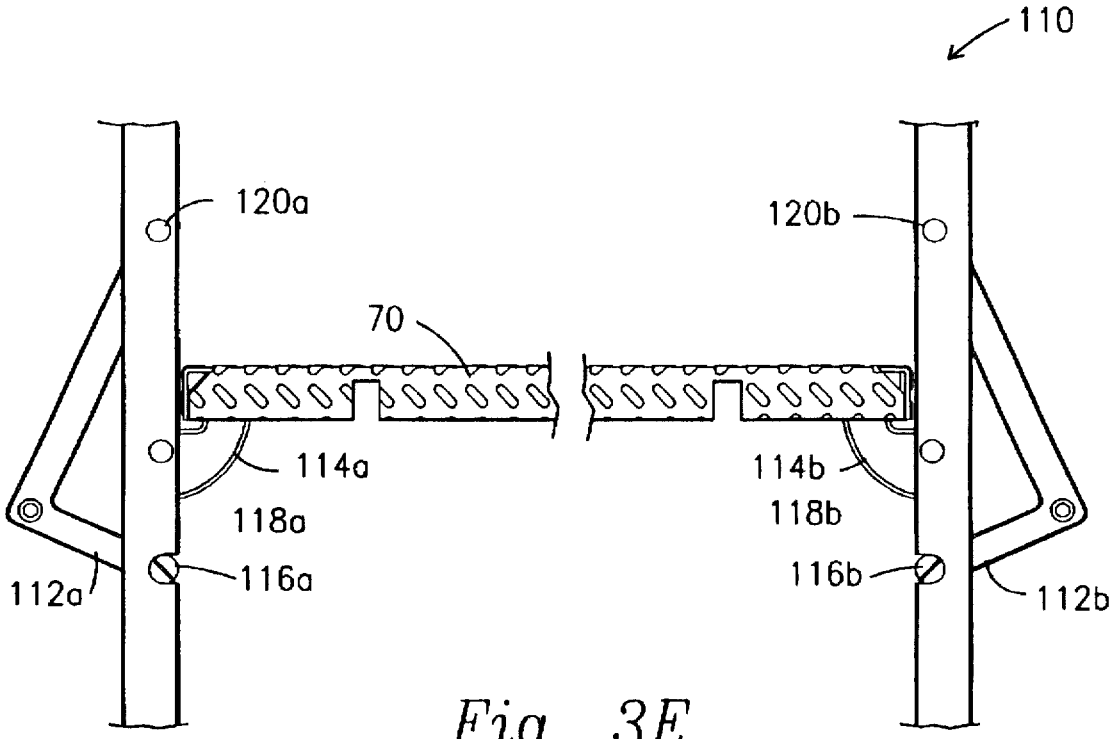
FIG. 3E is a side elevational view of the lifting device when the carrier support means is retracted.
Figure 3F:
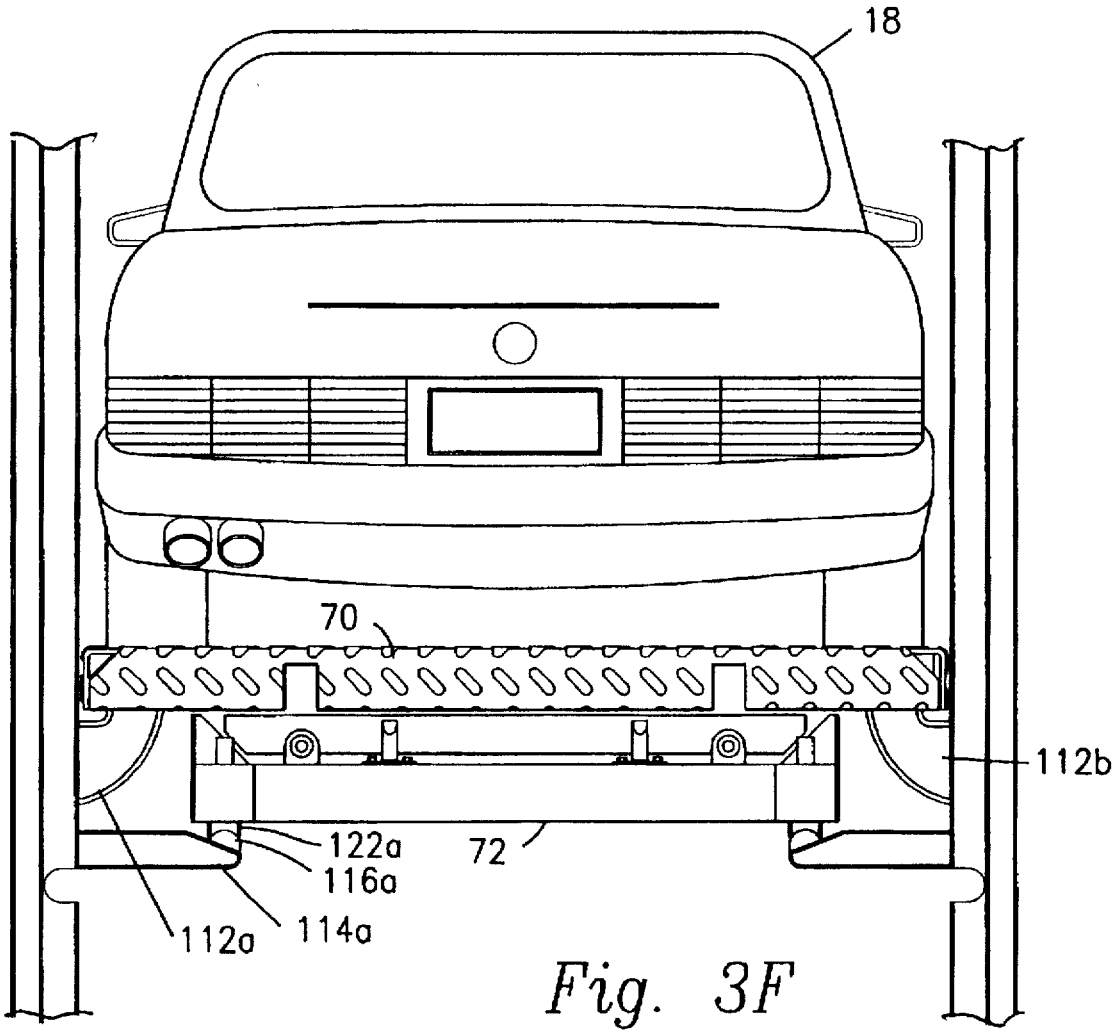
FIG. 3F is a front elevation, enlarged view of a vehicle supported on a pallet in the elevator.

FIG. 3E discloses the configuration of the device when carrier support members 112, 112b have been retracted; note that each arm 112a, 112b is "L"-shaped and mounted for rotation about pivot points 120a, 120b, respectively.

Figure 4:
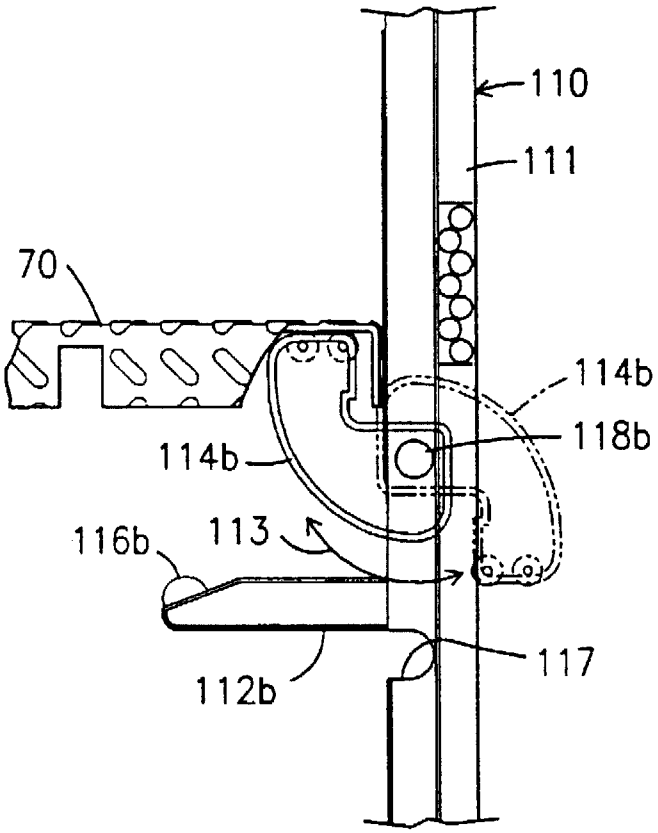
FIG. 4 is a side elevational, enlarged view of the rotatably mounted pallet support means depicted in FIGS. 3A–E, disclosing the retracted position thereof in phantom lines and the deployed, pallet-supporting position thereof in solid lines.

FIG. 4 depicts certain structural details of the mounting of arms 114a, 114b. Each arm may be thought of as a bell crank in view of its shape and in view of its pivotal mounting at pivot point 118b to lifting device 110. It should be clear from an inspection of FIG. 4 how rotation of arms 114a, 114b in the direction indicated by directional arrow 113 operates to support pallet 70 so that the underlying carrier may be withdrawn therefrom.

Figure 5:
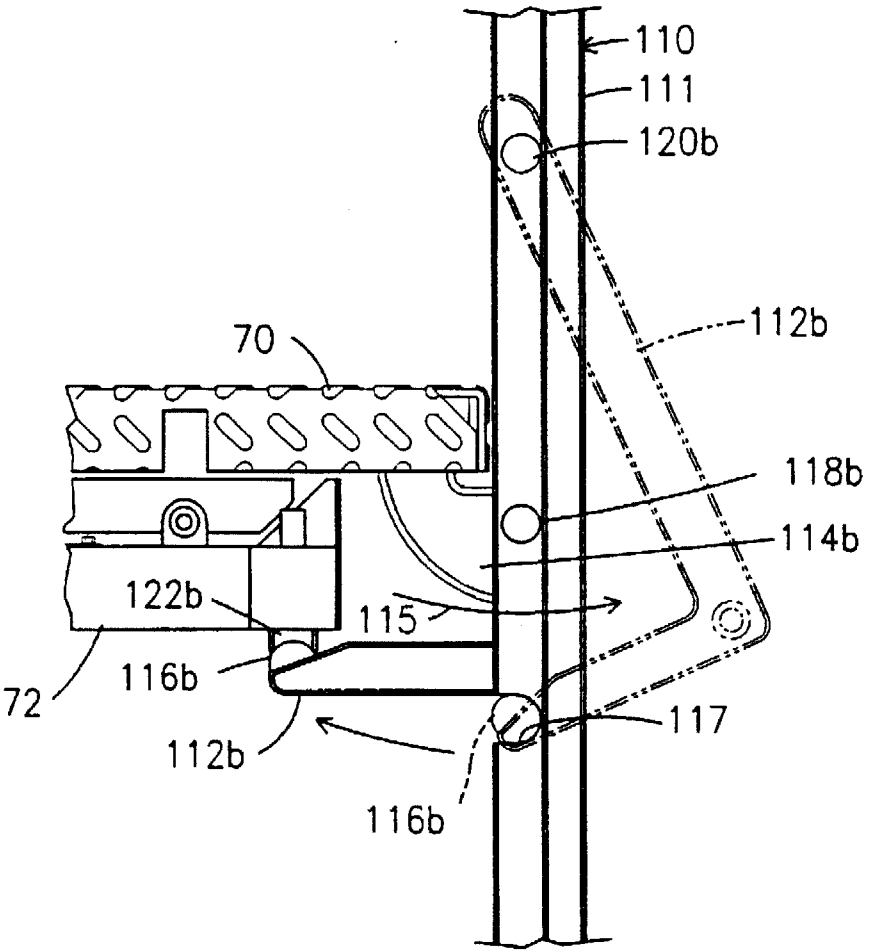
FIG. 5 is a side elevational, enlarged view of the pivotally mounted carrier support means of FIGS. 3A–E, disclosing the retracted position thereof in phantom lines and the deployed, carrier-supporting position thereof in solid lines.

FIG. 5 depicts similar structural details of arms 112a, 112b. Each arm has an "L" shape and is pivotally mounted to lifting 110 as at 120a, 120b. Note how carrier-supporting rails 116a, 116b retract into recess 117 formed in lifting 110 when arms 114a, 114b are fully retracted, i.e., when displaced in the direction of arrow 115. This enables a pallet positioned below the depicted pallet to be lifted to the position of the depicted pallet, i.e., when arms 112a, 112b are swung inwardly as indicated by directional arrow 117, they block such displacement of pallets.

Figure 6:
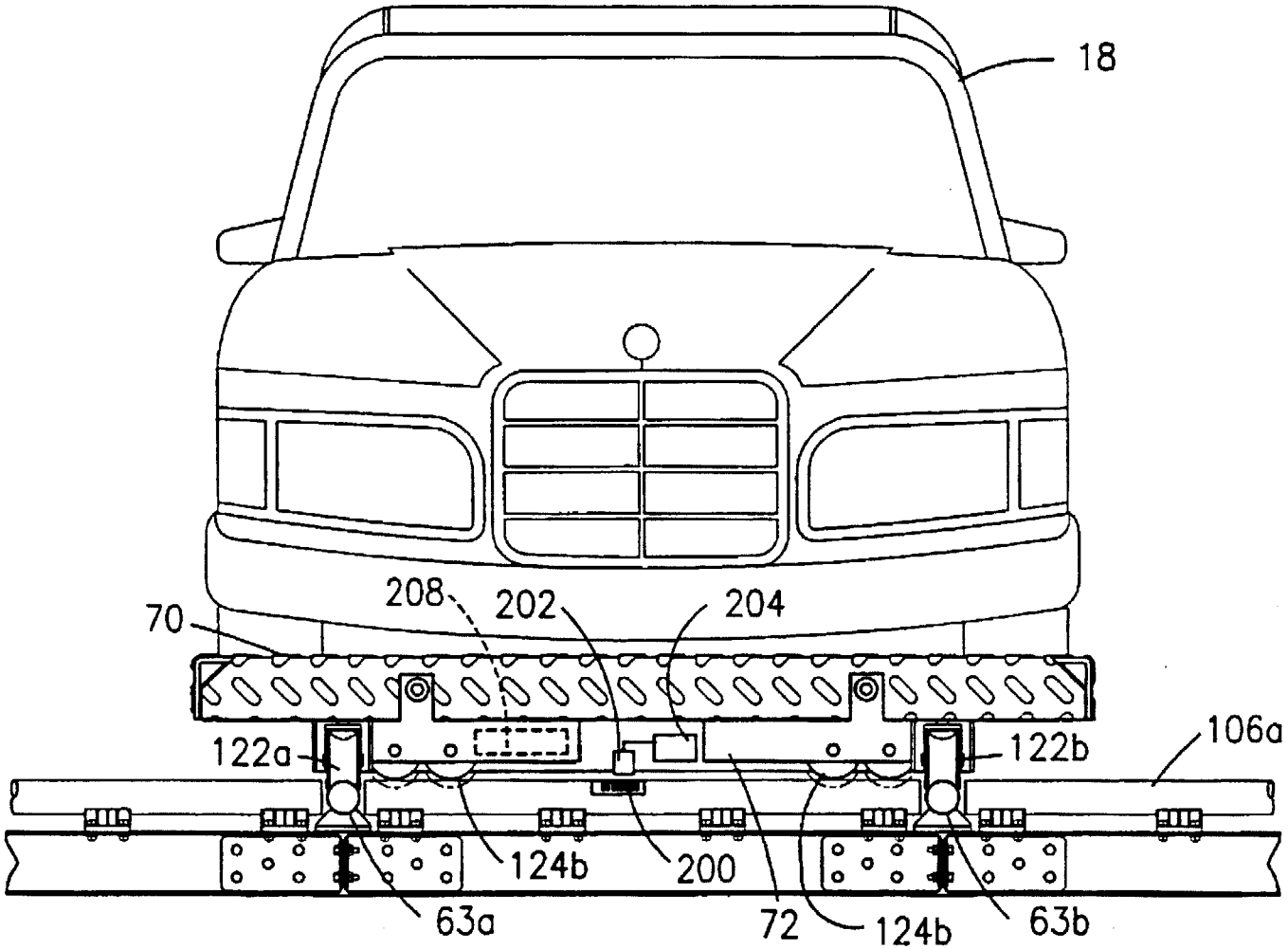
FIG. 6 is an end elevational view of a vehicle supported on a pallet which is in turn supported atop transverse parking rails that define a parking space.

The structure of the carrier that enables it to travel from the transversely extending central railway 106 (FIG. 1) to a longitudinally disposed parking space railway will now be described in connection with FIG. 6. Each carrier has two sets of rail-engaging wheels mounted to its underside. A first set of wheels 122a, 122b, mentioned earlier, engages longitudinal parking rails 63a, 63b (also see FIG. 2), and a second set of wheels 124a, 124b, disposed normal to said first set, engages transverse central rail 106a. The first set of wheels is normally elevated with respect to the second set and engages the longitudinal rails that define the parking spaces when lowered. In other words, the second set of wheels has an extended configuration and a retracted configuration, (see the phantom lines in FIG. 6), and are in said extended configuration when carrier 72 shuttles along central rails 106a, 106b; thus, the first set of wheels 122a, 122b is held above the longitudinal rails 63a, 63b to allow such transverse movement of said carrier. Upon arriving at a parking space, said second set of wheels 124a, 124b is retracted, thereby lowering wheels 122a, 122b onto longitudinal tracks 63a, 63b as depicted in FIG. 6. Carrier 72 can then enter the parking space, retract its pallet-supporting pins so that the pallet is supported by support posts (not shown in FIG. 6) and withdraw from beneath the pallet and return to central rail 106a, 106b upon extension of the second set of wheels.

An individually assigned parking space may be found by the carrier by many differing means such as physical pin coding, laser coding, and the like, all of which means are within the scope of this invention. For example, each parking space could be bar-coded and each carrier could carry a scanning means connected to the central computer. Similarly, each pallet would be bar-coded as well to facilitate its retrieval by a carrier.

Figure 7:
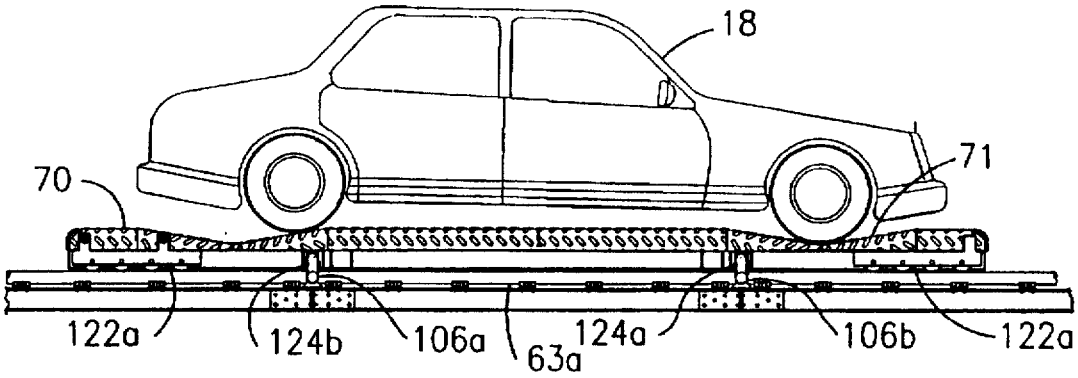
FIG. 7 is a side elevational view of a vehicle supported by a pallet that is in turn supported atop a transverse central rail.

FIG. 7 provides a side view of a vehicle 18 supported by pallet 70; each pallet may have a depression 71 for receiving the front wheels of the vehicle. This view depicts the individual rails 106*a*, 106*b* of transverse central rail 106; transverse wheels 124*a*, 124*b* are disposed in rolling engagement with said rails, whereas longitudinal wheels 122*a*, 122*b* are spaced apart from longitudinal rails 63*a*, 63*b* due to the extension of the transverse wheels.

Figure 8:
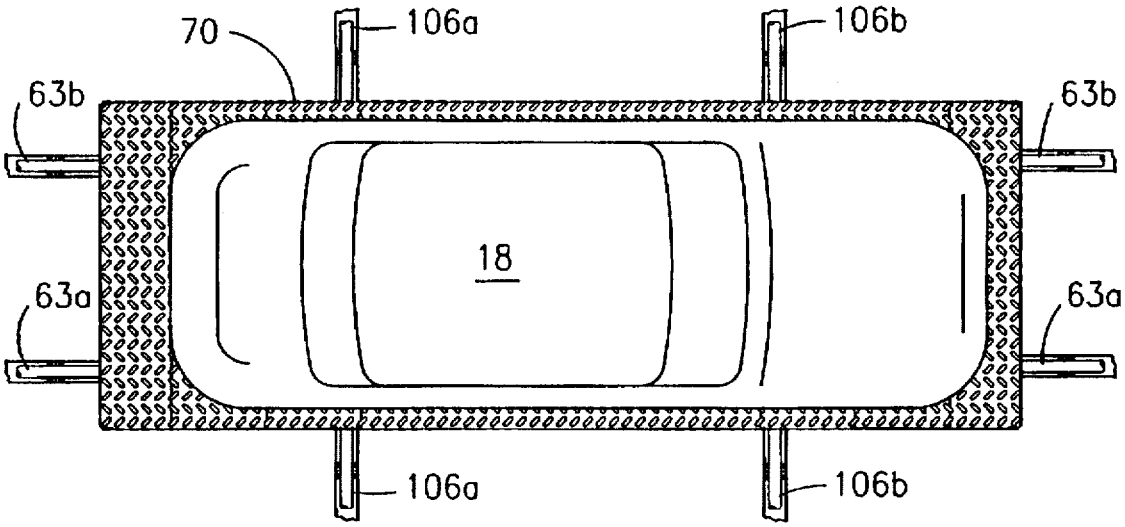
FIG. 8 is a top plan view of a vehicle on a pallet aligned with a parking space.

Pallet 70 need not be much larger than a typical vehicle 18 as best understood in connection with FIG. 8. Note that vehicle 18 is depicted in alignment with a preassigned parking space, i.e., FIG. 8 may be construed as depicting the vehicle just prior to its insertion into a parking space or just after its withdrawal from such a space.

The apparatus that effects vertical travel of pallet support members 114*a*, 114*b* will now be described.

Figure 9:
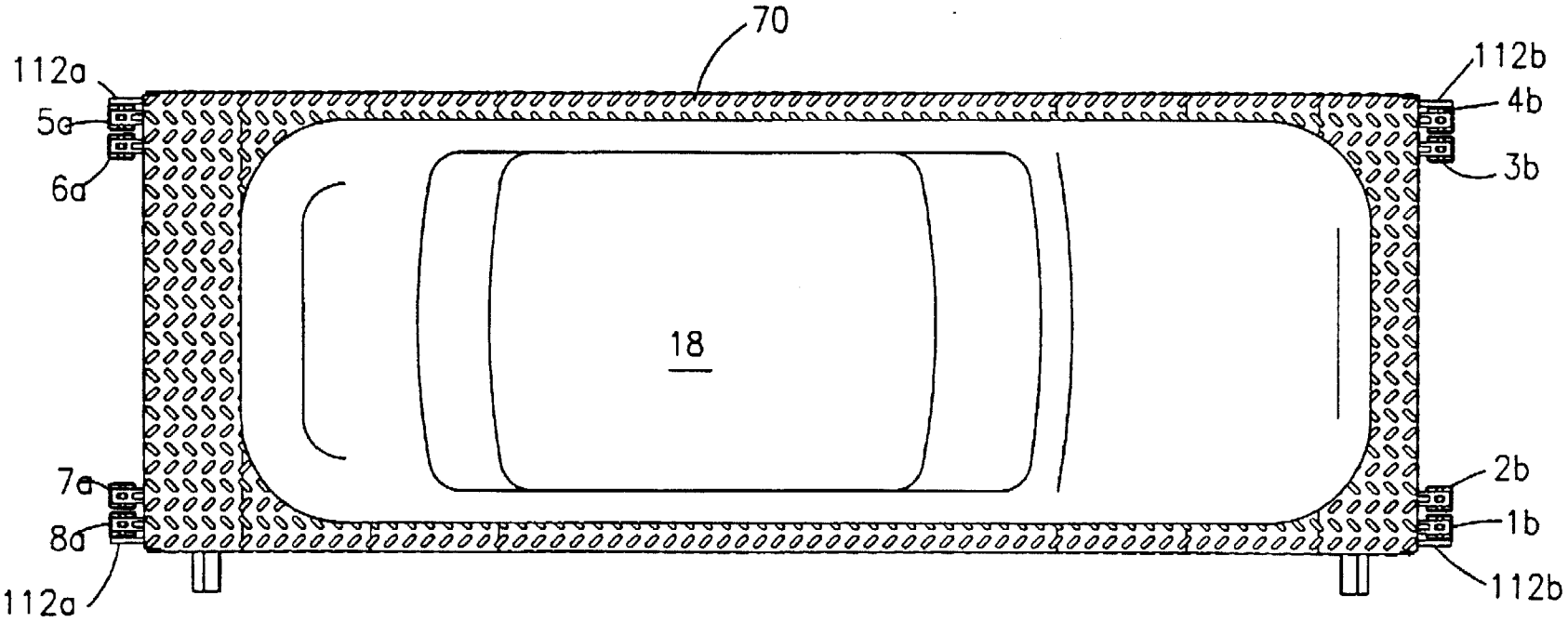
FIG. 9 is a top plan view of the novel lifting device.

As best understood in connection with FIG. 9, column 111 of the lifting device includes a total of eight upstanding steel channels arranged as depicted, i.e., said apparatus includes a pair of channels at each corner of pallet 70. For convenience, the channels are numbered 1–8 beginning at the lower right corner of FIG. 9 and continuing counterclockwise therefrom. Note that carrier support arms 112*a*, 112*b* are positioned on the outboard side of channels 1, 4, 5, and 8.

Again beginning at the lower right corner of FIG. 9 and continuing counterclockwise therefrom, the individual pallet support means, previously denoted 114*a* and 114*b* as a whole, are individually denoted 1*b*, 2*b*, 3*b*, 4*b*, 5*a*, 6*a*, 7*a*, and 8*a*.

Figure 10:
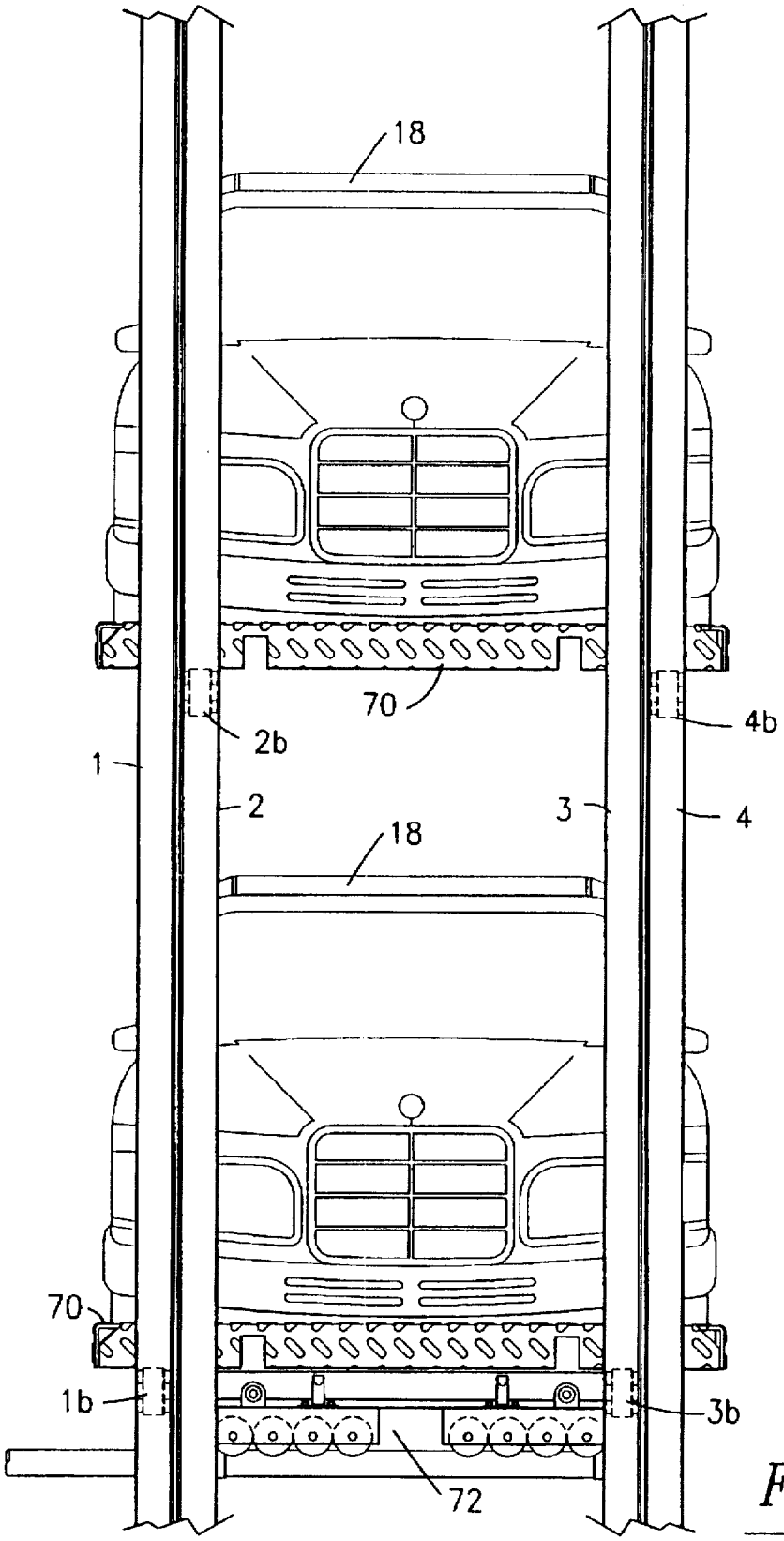
FIG. 10 is an end elevational view of the novel lifting device.

Significantly, as perhaps best understood in connection with FIG. 10, pallet support members 1*b* and 3*b* travel in unison with one another within their respective channels 1 and 3, and pallet support members 2*b* and 4*b* travel in unison with one another in their respective channels 2 and 4. It should be understood that the opposite side of the apparatus works in the same way, i.e., pallet support members 5*a* and 7*a* travel in unison in their respective channels 5 and 7 and pallet support members 6*a* and 8*a* travel in unison within their respective channels 6 and 8. Moreover, it should be understood that pallet support members l*b*, 3*b*, 5*a*, and 7*a* operate in unison, as do members 2*b*, 4*b*, 6*a* and 8*a* when the system is in operation. Accordingly, contiguous pallet support members such as members 1*b* and 2*b* may pass one another without interference when they are moving in opposite directions. For example, if a carrier removes the pallet and vehicle depicted at the top of FIG. 10 to carry said pallet and vehicle to a parking space within the novel parking garage, pallet support members 2*b* and 4*b*, under the command of a computer means, may travel downwardly in unison to prepare to receive another pallet, while pallet support members 1*b* and 3*b* may travel upwardly to deliver the vehicle and pallet at the bottom of FIG. 10 to the upper position.

If the vehicle in the uppermost position of FIG. 10 is not to be removed by a carrier but is instead to be lifted to a higher floor, pallet support members 2*b* and 4*b* maintain their FIG. 10 position, and pallet-support members 1*b*, 3*b* (not shown) that are on the same level as said members 2*b* and 4*b* would perform the lifting of said pallet and vehicle. Members 2*b* and 4*b* would then be free to travel downwardly in unison to support the next pallet in the system.

Thus, each set of four pallet supporting members reciprocates along a vertical path of travel between a pair of contiguous floors. Travel, whether upwardly or downwardly, of a pallet, with or without a vehicle thereatop, for a distance of more than one floor, is accomplished by the coordinated movements of the pallet support members as they pass a pallet from one set of four pallet support members to another set in a way remniscent of runners in a relay passing a baton, i.e., there must be a momentary horizontal alignment of two independent sets of four pallet support members to accomplish the handing of a pallet from one set of pallet support members to another.

Figure 11:
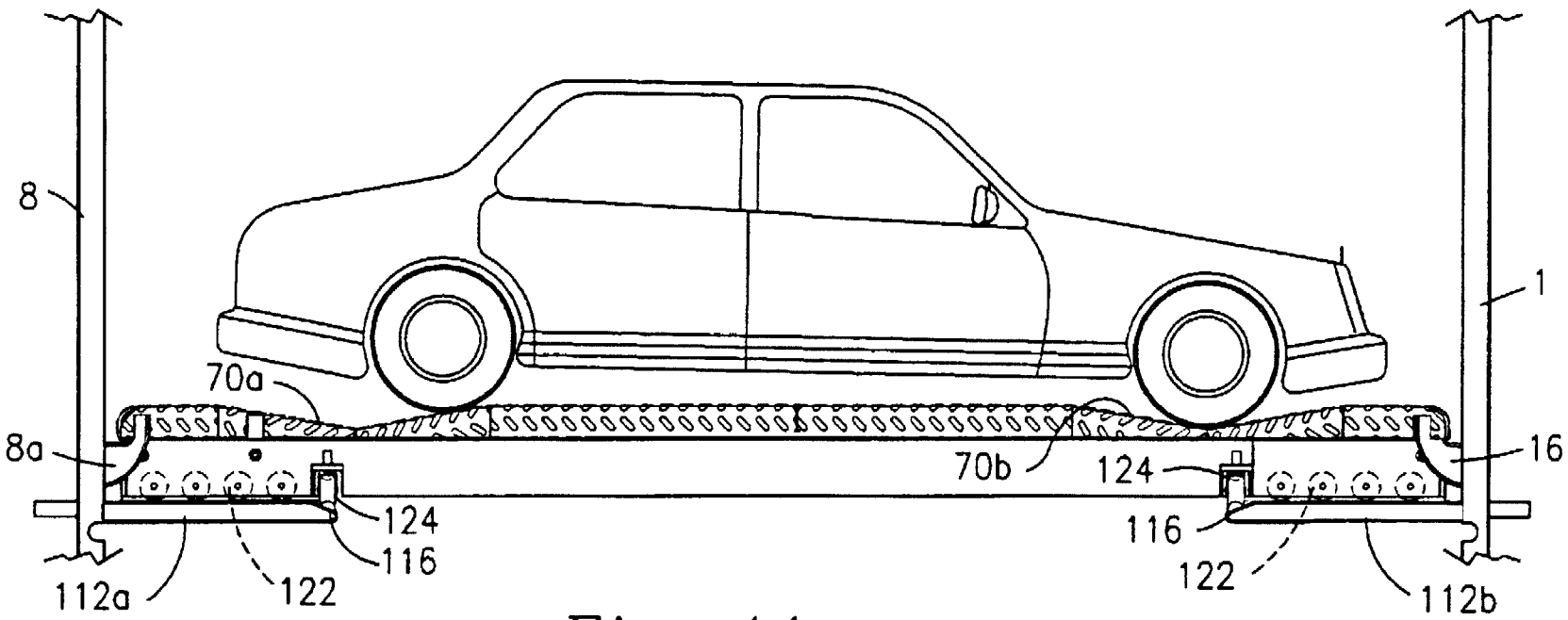
FIG. 11 is a side elevational view of a vehicle when positioned within the lifting device.

FIG. 11 depicts a vehicle when within the novel lifting device. Note how depressions 70*a*, 70*b* would receive the rear and front tires of a vehicle longer than the depicted vehicle. It should be understood that longitudinal wheels 122 are retracted in this view and that transverse wheels 124 are in engagement with rails 116 at the distal free ends of carrier support members 112.

Numerous mechanical, electrical, hydraulic, pneumatic or other suitable means can be employed to move pallet support arms 114 (also called pallet support members 1*b*, 2*b*, 3*b*, 4*b*, 5*a*, 6*a*, 7*a*, and 8*a* as aforesaid) upwardly or downwardly along their respective steel columns 111, (also called channels 1–8 as aforesaid), and all such means are within the scope of this invention.

Figure 12:
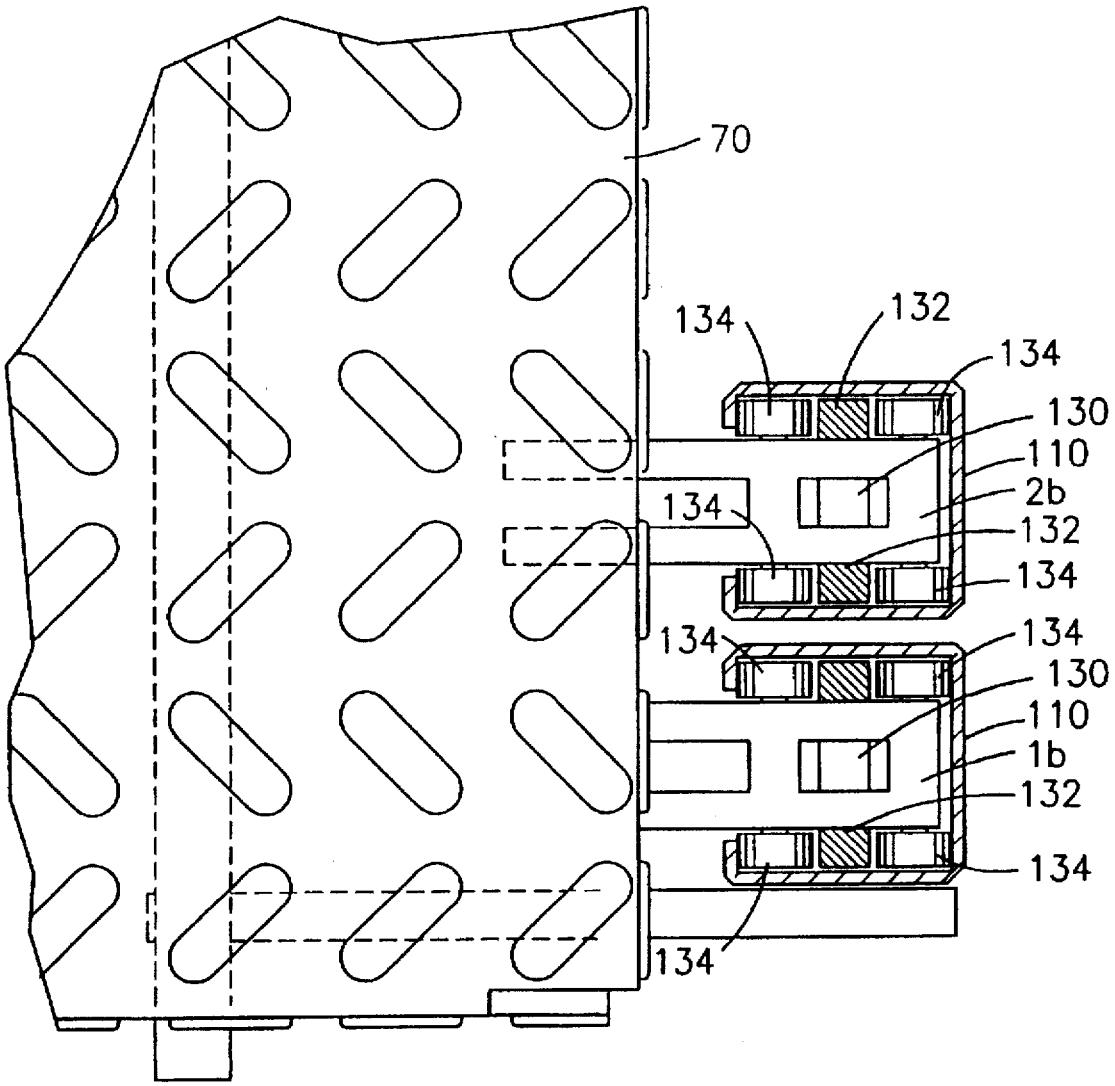
FIG. 12 is a broken away detailed plan view of the novel mechanism for raising and lowering the pallet support means between floors.

In the preferred embodiment, depicted in FIG. 12, pallet support members 1*b* and 2*b* are centrally apertured to slideably receive a vertical guide rod 130 that performs the function its name expresses. The members collectively denoted 132 are rack gears, and the members collectively denoted 134 are pinion gears. In the embodiment depicted in FIG. 12, the pinion gears are rotatably mounted in a fixed position and the rack gears are fixedly secured to their associated pallet support member and mounted for up and down travel. Alternatively, the pinion gears could be fixedly secured to their associated pallet support members and mounted for upward and downward travel along the extent of fixed position associated rack gears dependent upon the direction of rotation of the pinion gear. Either way, the upward and downward travel of each pallet support member 1*b*, 2*b* can be under the independent control of the central computer or there may be a personal computer dedicated to each task. Each pinion gear is mounted on the output shaft of a suitable electric motor or other suitable drive means.

The vertical travel of the other pallet support members is accomplished in the same way.

Note that each rack gear 132 could have a vertical extent of a single floor only, or that each rack gear could extend a plurality of floors. For example, each rack gear 132 could extend three floors so that a single drive means could accomplish lifting and lowering of a pallet over a three floor range; it should be recalled, however, that each set of pallet support members reciprocates only between two contiguous floors only as aforesaid.

Figure 13:
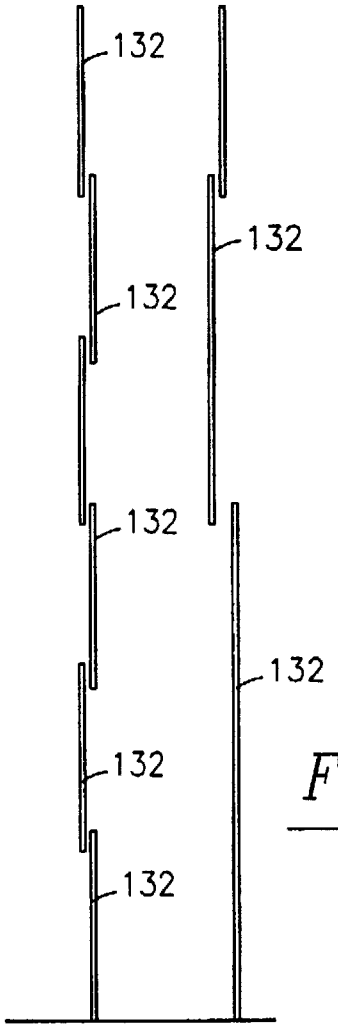
FIG. 13 is a diagrammatic view showing how the drive means of the lifting device may extend more than one floor.

This important feature of the invention may be better understood upon consideration of FIG. 13, where a plurality of racks 132 are depicted without the channels to which they are mounted to simplify the drawing. Note how the opposite ends of the racks overlap with the opposite ends of their contiguous racks. The overlapping enables the above-mentioned horizontal alignment of the pallet support members so that a pallet may be passed, baton-like, from one set of pallet support members to another. Note again that each rack 132 need not extend only one floor but may extend multiple floors as depicted, i.e., the rack at the lower right of FIG. 13 is depicted extending three floors and the one above it is depicted extending two floors, and so on. It should be remembered that the pallet support members themselves do not travel along the entire length of their associated rack gears and that each set of pallet support members must stop at the two extremes of their respective single floor length paths of travel.

Figure 14:
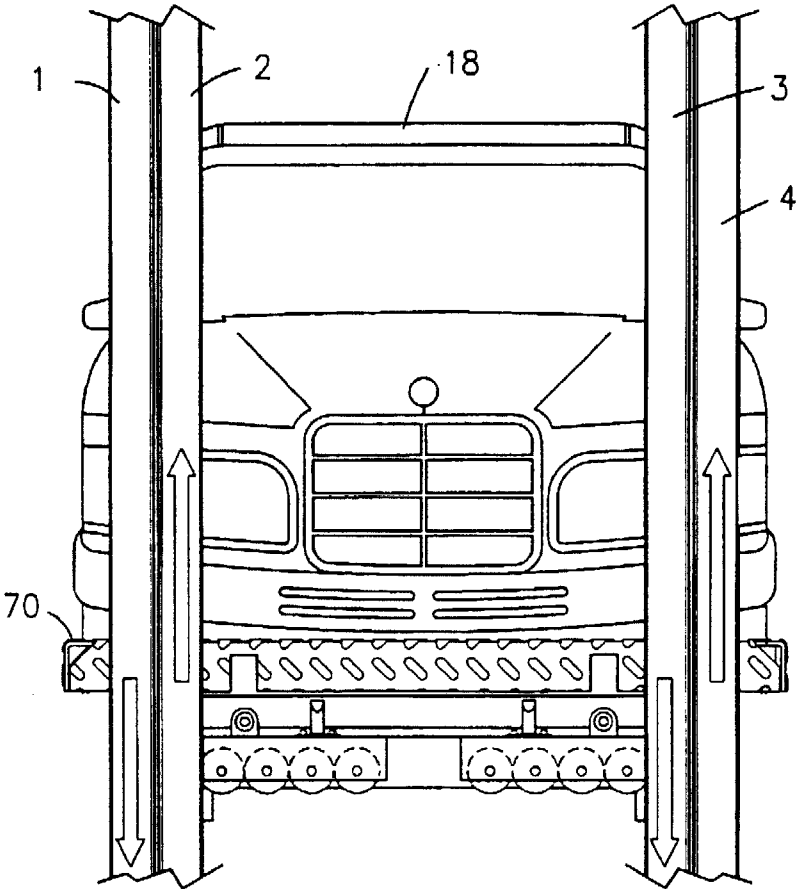
FIG. 14 is an end view similar to FIG. 10 but depicting how vertically overlapping sets of pallet support members allow a pallet to be passed from one set of pallet support members to another.

A still deeper understanding of the invention may be derived from FIG. 14. The set of four pallet support members in columns 2, 4, 6, and 8 deliver the pallets from the odd levels (1, 3, 5, etc.) to the next higher even level, and the set of four pallet support members 1, 3, 5, and 7 deliver pallets from the even levels (2, 4, 6, etc.) to the next higher odd level. Every other floor has an independent drive for the pallet support members 114*a* and 114*b*. As indicated by the directional arrows apearing in FIG. 14, the drives of channels 2 and 4 are operating in a direction opposite to that of the drives of channels 1 and 3. Thus, when the drives of channels 2 and 4 are in a raised position, the drives of channels 1 and 3 are in a lowered position to accept an incoming pallet. In the raised position, the pallet will either be pulled out of the lifting device by a floor level carrier (which requires the deployment of carrier support members 112), or delivered to the next floor level, according to the computer calculation, while the other set of pallet support members move back to their lowered position.

Upon arrival of a pallet and a vehicle such as vehicle 18 at the level assigned to the vehicle by the central computer, a carrier on that floor enters the lifting device and inserts itself beneath the pallet in the same way as when the carrier enters an arrival station. The earlier-mentioned lifting pins mounted on the top side of the carrier are extended to lift the pallet from pallet support arms 114, and the carrier then exits the lifting device and travels along the central railway 106*a* until it arrives at the parking space assigned to that particular vehicle and inserts the vehicle into its assigned space in the manner already described.

Figure 15:
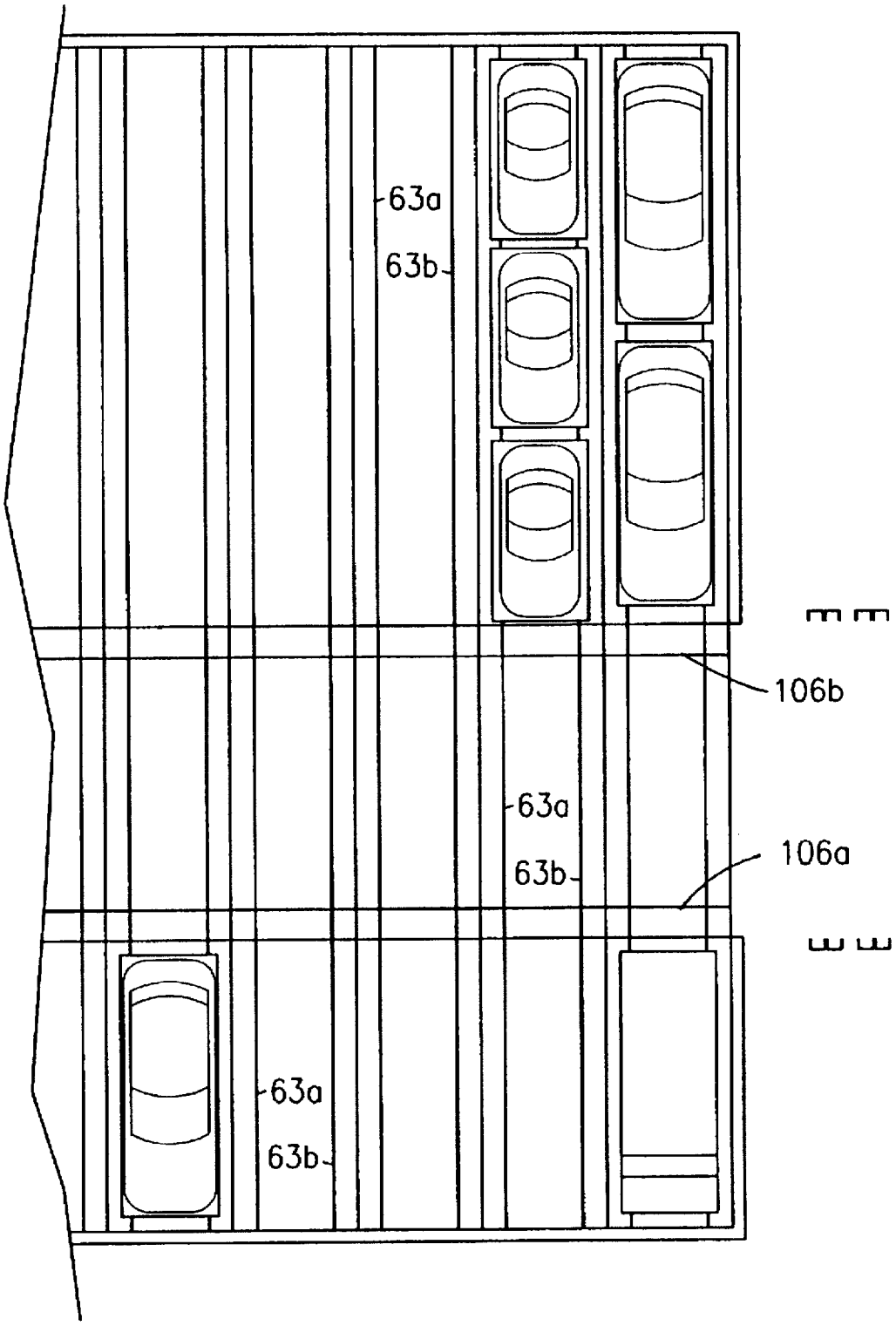
FIG. 15 is a plan view depicting how the novel system can be modified to park more than one vehicle in each parking slot defined by a pair of longitudinal rails.

As depicted in the lower half of FIG. 15, each parking space may have a depth sufficient to accommodate a single vehicle, or as depicted in the upper half of said Figure, two or more vehicles may be accommodated in parking spaces having greater depth.

The vehicles have been shown herein as being parked on the longitudinally aligned parking spaces defined by rails 63*a*, 63*b*, but it should be understood that the grid of rails or other guide means could be changed so that the vehicles are parked in a transverse orientation. Some applications might even call for a single garage having both parking orientations.

It should also be noted that the steel channels that form the frame of the lifting device could be positioned in different locations with respect to pallet 70, and not just at longitudinally spaced apart opposite ends thereof as shown herein. With minor design changes, the channels may be positioned on transversely spaced apart sides of the pallet or even coincident with the corners of the pallet. Moreover, a single steel channel could replace each double channel, but it is important that there be two pallet support members with independent drives therein as disclosed.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method for parking vehicles in a parking garage having more than one floor, comprising the steps of:

positioning a pallet at an arrival station in raised relation to a support surface;

inserting a carrier beneath said pallet;

lifting said pallet from said support surface, said carrier being adapted to include pallet-lifting means for performing said lifting;

employing said carrier to transport said pallet and said vehicle to a lifting device;

deploying a carrier-supporting means into said lifting device;

inserting said carrier and hence said pallet and said vehicle into said lifting device;

deploying a pallet supporting means into said lifting device to lift said pallet from said carrier to support said pallet independently of said carrier;

withdrawing said carrier from said lifting device after said pallet is supported independently of said carrier-supporting means;

employing said pallet supporting means to lift said pallet one floor, said lifting bringing said pallet to a second floor of said parking garage;

deploying a carrier supporting means associated with said second floor into said lifting device;

inserting a second carrier stationed on said second floor into said lifting device;

employing said second carrier to lift said pallet from said pallet supporting means by activating a pallet-lifting means that forms a part of said second carrier; and transporting said pallet to an assigned parking space.

2. The method of claim 1, further comprising the steps of structuring each lifting device so that said pallet supporting means can shuttle between two contiguous floors only, and lifting or lowering a pallet and a vehicle atop such pallet to or from an assigned floor, respectively, by repeatedly lifting or lowering the pallet and vehicle one floor and transfering the pallet and vehicle to a contiguous pallet supporting means for lifting or lowering one additional floor for as many times as is required.

3. The method of claim 1, further comprising the step of electronically measuring a vehicle prior to its entry into the facility, admitting said vehicle if its dimensions fall into a predetermined acceptable range, and denying access into the facility if its dimensions fall outside said predetermined acceptable range.

4. The method of claim 1, further comprising the step of electronically videotaping a vehicle prior to its entry into the facility to create a record of the physical condition of the vehicle prior to said entry.

* * * * *